United States Patent [19]

Winston

[11] Patent Number: 4,588,193

[45] Date of Patent: May 13, 1986

[54] TWO-VALUE PLAYING CARDS

[76] Inventor: Scott E. Winston, Eagle Rock Village-Bldg. 19, Apt. 3B, Budd Lake, N.J. 07828

[21] Appl. No.: 641,864

[22] Filed: Aug. 17, 1984

[51] Int. Cl.[4] ..... A63F 1/00

[52] U.S. Cl. ..... 273/304; 273/305; 273/306

[58] Field of Search ..... 273/304, 305, 306, 303; D21/42, 43, 44, 45

[56] References Cited

U.S. PATENT DOCUMENTS

| | | | |
|---|---|---|---|
| D. 169,847 | 6/1953 | Inman | 273/304 X |
| 821,781 | 5/1906 | Cadwallader | 273/304 |
| 1,551,761 | 9/1925 | McCarroll | 273/304 |
| 4,219,197 | 8/1980 | Acuff | 273/299 |

*Primary Examiner*—Anton O. Oechsle

[57] ABSTRACT

A deck of playing cards preferably comprising sixty two-value cards, whereby the deck consists of three different suits with four different number values per suit, and twelve half-wild cards consisting of a fifth number value which is wild in terms of its suit. The deck is uniquely designed so that every number value of a given suit is paired once with every number value of the other suits. In this manner, the deck constitutes a fair deck in which the probabilities of any given dealt hand can be predetermined so that successful winning stratagies can be developed. The deck is mathematically designed to overcome the statistical inadequacies of two-valued cards of the prior art. The deck may also be supplemented with a die representing the different suits, for games in which one suit ranks differently than another suit.

6 Claims, 12 Drawing Figures

TWO-VALUE PLAYING CARDS

FIELD OF THE INVENTION

This invention relates to playing cards of the familiar generally rectangular type, each card of the deck having generally identical sizes and rear faces. The front faces denote different values and suits, although they need not consist of the same values and suits as is common in a standard fifty-two card deck of playing cards. More particularly, it relates to a deck of playing cards in which all of the individual cards represent two different card values.

BACKGROUND OF THE INVENTION AND DESCRIPTION OF PRIOR ART

Packs of playing cards comprising fifty-two cards, each denoting a different value of one of four suits (clubs, diamonds, hearts, and spades) and herein referred to as a standard deck, have a long and ancient history. In the past there have been numerous proposals for variations in the standard deck. A known alteration in the standard deck has been to provide a deck of cards in which each individual card represents more than one value, as indicated on its front face.

For example, U.S. Pat. No. 821,781 (Cadwallader, May 29, 1906) describes a deck of cards, each with two values. The two values were designed so that they could be distinguished as either major or subordinate suits.

U.S. Pat. De. No. 118,977 (Kermode, Feb. 13, 1940) shows a deck of fifty-five cards comprised of front faces partially occupied by a domino representation, a letter of the alphabet, and a standard playing card marking.

U.S. Pat. De. No. 212,239 (Schick, Sept. 17, 1968) shows an ornamental design for a standard deck of playing cards with two values each.

U.S. Pat. De. No. 222,490 (Alaska, Oct. 26, 1971) shows a standard deck of cards which are split into two values across the middle by means of transparent-/opaque layers in each half.

U.S. Pat. No. 4,170,358 (Hancock, Oct. 9, 1979) shows another two-valued standard deck of cards which was an improvement on the prior art. The Hancock patent cites many other examples of two-valued cards known in the prior art. Hancock notes that none of the packs of split playing cards has achieved widespread acceptance, dispite their apparent offering of increased ranges of card playing possibilities. In most cases, the arrangement of the two zones on the split cards of the prior art renders the decks difficult and confusing to read and play. The preferred embodiment of the Hancock patent is to yield a pack of cards which essentially comprises two standard decks; a major suit deck and a minor suit deck, whereby each individual deck is designed to be distinctly substantiated from the other deck as indicated by various shadings or colors.

It is important to note that Hancock uses each value only twice, therefore limiting the number of combinations obtainable. There is an almost random coupling of the two values which appear on each card. The specific couplings of suit/value pairs on an individual card have been inappropriate from a statistical point of view, resulting in yet another deck of two value cards which has not achieved widespread acceptance, since it is apparently unsatisfactory in play. Two value cards of the prior art have not constituted fair games when used in play.

A fair game shall be considered one in which the probabilities of any given hand can be predetermined so that successful winning strategies can be developed. With a standard deck, for example, a poker hand of four of a kind beats a full house because the probability of being dealt four of a kind is less than the probability of being dealt a full house. The more difficult the hand, the greater its rank. This holds true for any standard deck, and can be readily predetermined using the correct mathematical probability counting techniques. Since all standard decks are the same, the rules of all card games are the same for all standard decks. Hence standard decks result in fair games.

In the two-valued standard decks of the prior art, an inadequacy in the development of these decks neglects consistency in the probabilities of any given game in which the two standard decks are considered in play simultaneously. Thus the two-value decks of the prior art do not constitute fair games. A somewhat rigorous mathematical explanation seems necessary. The following definition is required: the number of subsets, each of size 'r', that a set with 'n' elements has is called the number of combinations of 'n' things 'r' at a time and is denoted by $$\binom{n}{r}.$$

Mathematically, $$\binom{n}{r} = \frac{n!}{r!\,(n-r)!} \text{ where } n! = \text{'}n\text{' factorial} = (n)(n-1)(n-2)\ldots(2)(1) \tag{1}$$

It should be noted that the order of things is not important (ex: 1,2,3=1,3,2=3,2,1, etc.).

EXAMPLE 1

The number of distinct five card hands that can be dealt from a standard fifty-two card deck can be calculated using equation (1) as follows:

$$\binom{52}{5} = \frac{52!}{5!47!} = 2{,}598{,}960 \text{ different five card hands}$$

EXAMPLE 2

The number of five card hands of poker resulting in a full house (3 of one kind and 2 of another kind) that can be dealt from a standard fifty-two card deck is calculated as follows:

$$\text{\# of full house hands} = \binom{13}{1}\binom{4}{3}\binom{12}{1}\binom{4}{2} = 3744$$

This holds true because there are thirteen different values per suit (A,2,3, . . . , J,Q,K). You must choose one of these values $$\left(\text{hence}\binom{13}{1}\right)$$

and be dealt 3 of them. Suppose you are dealt 3 Jacks. There are a total of 4 Jacks in a standard deck, and you must choose any 3 of them $$\left(\text{hence}\binom{4}{3}\right).$$

You still need to be dealt 2 more cards and they both must be of the same value. You cannot be dealt another Jack, or your poker hand would become four of a kind. Therefore you must choose one of the remaining 12 values $$\left(\text{hence}\binom{12}{1}\right).$$

Suppose you are dealt a six. There are four sixes in a standard deck and you must choose any two of them $$\left(\text{hence}\binom{4}{2}\right).$$

Therefore the number of possible full house hands in a standard fifty-two card deck when you are dealt five cards is:

$$\binom{13}{1}\binom{4}{3}\binom{12}{1}\binom{4}{2} = 3744.$$

EXAMPLE 3

What is the probability of being dealt a full house in five cards using a standard fifty-two card deck?

Probability of a full house =

$$\frac{\text{\# of possible full house hands}}{\text{\# of total possible 5 cards hands}} = \frac{3744}{2598960} = .00144$$

This means that a player will be dealt a full house in his or her first five cards 0.144% of the time using a standard fifty-two card deck.

In the two-value standard decks of the prior art, consistent probabilities cannot be calculated because of the seemingly random ordering of the two value-suit pairs on each card. In U.S. Pat. No. 4,170,358 for example, Hancock shows the following value-suit pairs as part of a two-value deck (note that J=Jack, C=club, D=diamond, H=heart, and S=spade. Hence J-C/9-S=the Jack of clubs coupled with the nine of spades):

J-S/8-H J-H/10-D J-D/7-C J-C/9-S 3-S/J-C 4-H/J-S 6-D/J-D 5-C/J-H

These are all the cards which contain Jacks in this particular deck (since each value appears only twice. With this deck or any other variation of a two-value deck of the prior art, a fair game does not exist, as the example below will illustrate.

EXAMPLE 4

Given a two-valued standard deck of the prior art containing the eight cards shown above, the number of five card poker hands resulting in a full house should be calculated as follows (when either value can be included in a players hand):

$$\binom{13}{1}\binom{8}{3}\binom{12}{1}\binom{8}{2} = 244{,}608$$

This was calculated using a mathematical treatment similar to Example 2. However, the above calculation would only hold true for full house hands of three Jacks and two Aces, Kings, or Queens. Note that a Jack is found in combination with a 3,4,5,6,7,8,9, and 10. If the Jack were to be included as part or the full house, then the other value on the card could not be included in the same hand. As a result, the number of five card poker hands consisting of three Jacks and two 3,4,5,6,7,8,9, or 10's would be $$\binom{13}{1}\binom{8}{3}\binom{12}{1}\binom{7}{2} = 183{,}456$$

Suddenly the probability of being dealt a full house is not consistent. In fact, since the prior art does not restrict the two-value standard deck pairings to specific combinations for a complete deck, then every different deck has its own set of statistics. In effect, no two prior art two-value decks with different couplings of the standard cards will abid by the same set of probabilities. This has severely limited the utility of the prior art.

In addition, it should be noted that when two decks are combined into one two-valued deck, no statistical advantage is derived if the two decks are considered distinct and separate (with major or minor suits for example). In terms of the probabilities, in poker for example, there would be twice as many full house hands, which initially appears advantageous. However, there are also twice as many possible five card hands as well, so following the method of Example 3, the overall probability of being dealt a full house does not change at all. Thus the advantage of the two-value standard decks of the prior art seems strictly ornamental, and not at all statistical.

SUMMARY OF THE INVENTION it is an object of the present invention to provide a new improved deck of playing cards. It is a further object to provide a pack of cards in which all of the cards consist of two different suit/value combinations, but with which it is nevertheless simple and easy to play card games. In addition, the two-value deck of the present invention constitutes fair games when used in play, and all combinations of the different suit/value pairs are found within a forty eight card deck (or optionally a sixty card deck containing twelve half-wild cards), whereby each card has same generally rectangular configuration and size, and a visually similar rear face.

The present invention offers distinct improvements to the prior art by altering the number of suits from four to preferably three. These suits need not consist of those ordinarily encountered in a standard deck (clubs, diamonds, hearts, and spades). Any three distinct geometrical configurations or patterns may suffice. Optionally, the three suits may be distinguished by different colors, or by different combinations of colors and patterns. The present invention also requires that the number of different values per suit be reduced from thirteen to preferably either four or five. In this manner a fair deck is produced in which every value of a given suit is paired once with every value of the other suits. This requires a forty-eight card deck (with four values per suit) and permits every combination of two-values of different suits to potentially occur within a given card game.

Unlike the prior art, no distinction is made between the two suit-value pairs on a given card (ie: there are no major or minor suits). In addition, no suit-value pair appears twice on the same card, and no cards repeat. Each card is designed with both display areas appearing in the upper lefthand corner and in the lower righthand corner of the front face. A display area consists of a suit-value pair. The display areas should be drawn so that the values (preferably numbers) appear right-side-up when the front face of the card is rotated so that the values appear in the upper lefthand corner. In this manner the two-valued cards of the present invention can be held comfortably in normal holding and playing procedures.

As an additional option, the present invention can include a standard six sided cubic die with the different suits appearing on the opposite faces of the cube. This can be incorporated into card games requiring one suit of different rank than the other suits.

The use of the two-value deck of the present invention offers substantial statistical improvements to well known standard deck games and also allows for the development of new card games which cannot be found in the prior art.

DESCRIPTION OF THE PREFERRED EMBODIMENTS

Preferably, the deck of cards according to this invention has sixty two-value cards, twelve of which are half-wild cards. With the exception of the half-wild cards, the two-value cards consist of three suits, each with four different numbers per suit. The half-wild cards all consist of a fifth number which is wild in terms of its suit (and thus half wild since its number value is specified but its suit is not). Each half-wild card is coupled with one of the twelve other values (note: three suits with four numbers per suit result in twelve different values).

Statistically, the present invention has been designed to provide a fair game which includes all two-value combinations (except those which duplicate suits) within a deck of cards as similar to a standard deck as possible. The minimum number of two-value cards constituting a fair game in play can be computed using the following equations:

$$a = \binom{x}{2} = \frac{x!}{2!(x-2)!} = \frac{(x)(x-1)}{2} \quad (2)$$

$$b = \binom{y}{2} = \frac{y!}{2!(y-2)!} = \frac{(y)(y-1)}{2} \quad (3)$$

$$d = a - bc \quad (4)$$

where a = the minimum number of two-value cards constituting a fair deck, where every combination of two different values appears on a card within the deck.

b = the minimum number of two-value cards in a fair deck, where each card contains the same suit twice.

c = the number of different suits in the deck.

x = the number of different values in the deck = (c)(y).

y = the number of different values per suit.

d = the minimum number of two-value cards in a fair deck where no card contains two values of the same suit.

For example, a standard deck has fifty-two different values (hence x = 52), so that from equation (2) 1,326 different two-value cards would be required to include every combination of two-values. If, as in the preferred embodiment of the present invention, the two-value deck were designed so that no single card contained two values of the same suit, equations (2), (3), and (4) dictate that 1,014 different cards would be required to transform a standard deck into a fair two-valued deck.

Many different combinations of suits and values are contained within the embodiment of the present invention. However, the requirement of a fair two-value deck reduces the number of different suits as well as the number of different values per suit (in relation to the standard deck) if a reasonable number of cards is desired for a complete deck. Table I shows the various different fair two-value card decks which have utility as new card decks under the present invention. The included combinations were selected to require between 45 and 75 different two-value cards per complete deck (not including wild cards). With this range of cards per fair deck, these two-value decks most closely approximate the standard deck in terms of both the number of cards and the ease of shuffling. Moreover, each of the different fair two-value decks of Table I yield substantially different probabilities than a standard deck of playing cards. These new card decks also facilitate the creation of new and different card games for each deck.

It is preferred that each card be designed with both display areas appearing near the upper lefthand corner and also near the lower righthand corner. The normal sized playing card has dimensions generally equal or proportional to 6.25 cm × 8.75 cm. For this sized card, one display area (referred to as suit-value 1), comprising both a value and a suit, should appear within 2 cm of the upper lefthand corner. The other display area (referred to as suit-value 2) should be drawn to the same scale as suit-value 1, and should appear directly below suit-

TABLE I

| Deck # | # of Suits | # of Values per Suit | 'a' [Eq. (2)] | 'd' [Eq. (4)] | 'e'* |
|---|---|---|---|---|---|
| 1 | 3 | 4 | 66 | 48 | 54 |
| 2 | 3 | 5 | — | 75 | — |
| 3 | 4 | 3 | 66 | 54 | 48 |
| 4 | 5 | 3 | — | — | 75 |
| 5 | 6 | 2 | 66 | 60 | — |
| 6 | 7 | 2 | — | — | 49 |
| 7 | 8 | 2 | — | — | 64 |
| 8 | 2 | 5 | 45 | — | — |
| 9 | 2 | 6 | 66 | — | 60 |
| 10 | 2 | 7 | — | 49 | — |
| 11 | 2 | 8 | — | 64 | — |
| 12 | 5 | 2 | 45 | — | — |

*= 'e' = the minimum number of two-value cards in a fair deck where no card contains two values of the same number.

value 1, between 2 cm and 4 cm from the upper lefthand corner of the card. When the card is rotated 180° clockwise, the display areas should reappear in the upper lefthand corner, only the positions of suit-value 1 and-suit-value 2 should be reversed. In this manner, either display area can be made to appear more valuable in a given hand by rotating the card clockwise (or counterclockwise) until the desired suit-value appears uppermost in the upper lefthand corner.

A deck of cards according to the invention may advantageously contain wild cards. Since the preferred decks contain less suits and values than a standard deck, it is preferred that any wild cards be only half-wild. For example, a new deck of cards with three suits and four values per suit can be designed to comprise a fair deck with forty-eight two-value cards. To enhance the variety of possible hands, a fifth value can be added to the deck. Since this would ordinarily require an additional twenty-seven cards (to maintain fairness), the fifth value can be designed to be wild in terms of suit only. In this manner, only twelve additional cards would be required to retain fairness. This yields a complete deck of sixty cards, which has an additional advantage over the standard fifty-two card deck. In games where all the cards are dealt out prior to play, a sixty card deck can be evenly dealt out to 2,3,4,5,6,10, or 12 players. In contrast, a standard fifty-two card deck can only be dealt out evenly to 2,4, or 13 players.

The accompanying drawings illustrate diagrammatically a deck of cards according to the invention, with two-value cards coupled as described above. It is understood that the choices of suits (circles, squares, and triangles) are illustrative only, and not exhaustive. Similarly, the values (1,2,3,4, and 5) are illustrative only, and not exhaustive. The rear face of the deck is not shown because the present invention is not meant to be a design patent. In the discussion that follows, specific display areas shall be referred to by their suit-value pairs (ex: S-3, where S=square, and 3=the appropriate value). Suits shall be denoted as follows: S=square, C=circle, T=triangle, and W=wild (for the half-wild cards). Values shall be denoted by the appropriate number. Any two-value deck of cards based on the information of Table I is within the scope of the invention, regardless of ornamental design.

REFERENCE TO THE DRAWINGS

DESCRIPTION OF THE SPECIFIC PREFERRED EMBODIMENT

Figure 1:
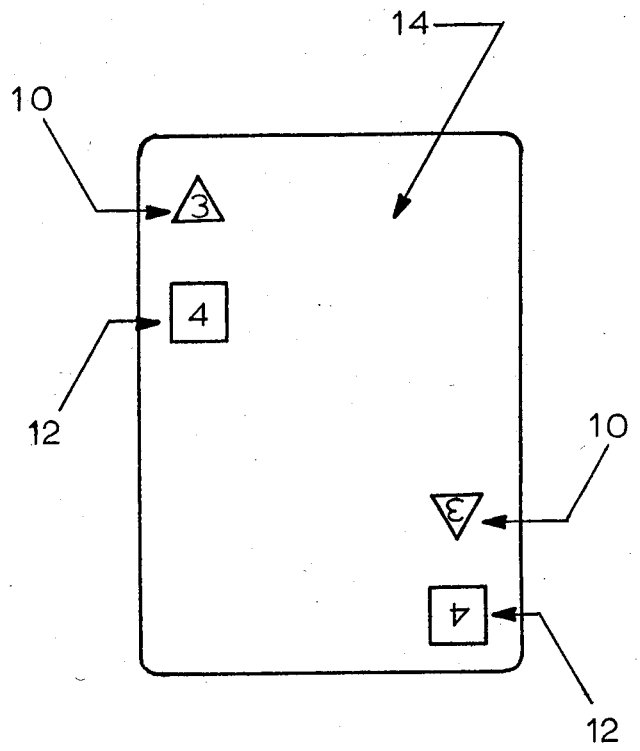
FIG. 1 shows a front face of a two-value card comprising one of a deck of cards according to the invention.

The two-value card shown in FIG. 1, which is typical of the forty-eight two-value cards making up the deck (not including half-wild cards), has one display area, 10, represented by T-3, and a second display area, 12, represented by S-4. Note that by rotating the card clockwise (or counterclockwise) 180°, the T-3, 10, which has been in the uppermost position in the upper lefthand corner, has been replaced by the other suit-value, 12, which now occupies the uppermost position in the upper lefthand corner. Similarly, the S-4, 12, which had been situated below the T-3, 10, has been replaced by the T-3, 10. A players hand can be easily arranged by rotating each individual card in this manner until the desired display area appears in the uppermost position of the upper lefthand corner. This allows a normal card to be held comfortably in the typical fan arrangement in which the majority of card games are played. The remainder of the front face of the card, 14, and the rear face as well (not shown), can have any ornamental design(s) which does not detract from the nature of standard card games. Preferably, all of the cards in the deck shall have the same rear faces, so that they are indistinguishable from one another. Preferably the rear face design is symmetrical about the imaginary diagonal line which bisects each card. In this manner, an opponent cannot tell which way a player has rotated his or her cards.

Figure 2A:
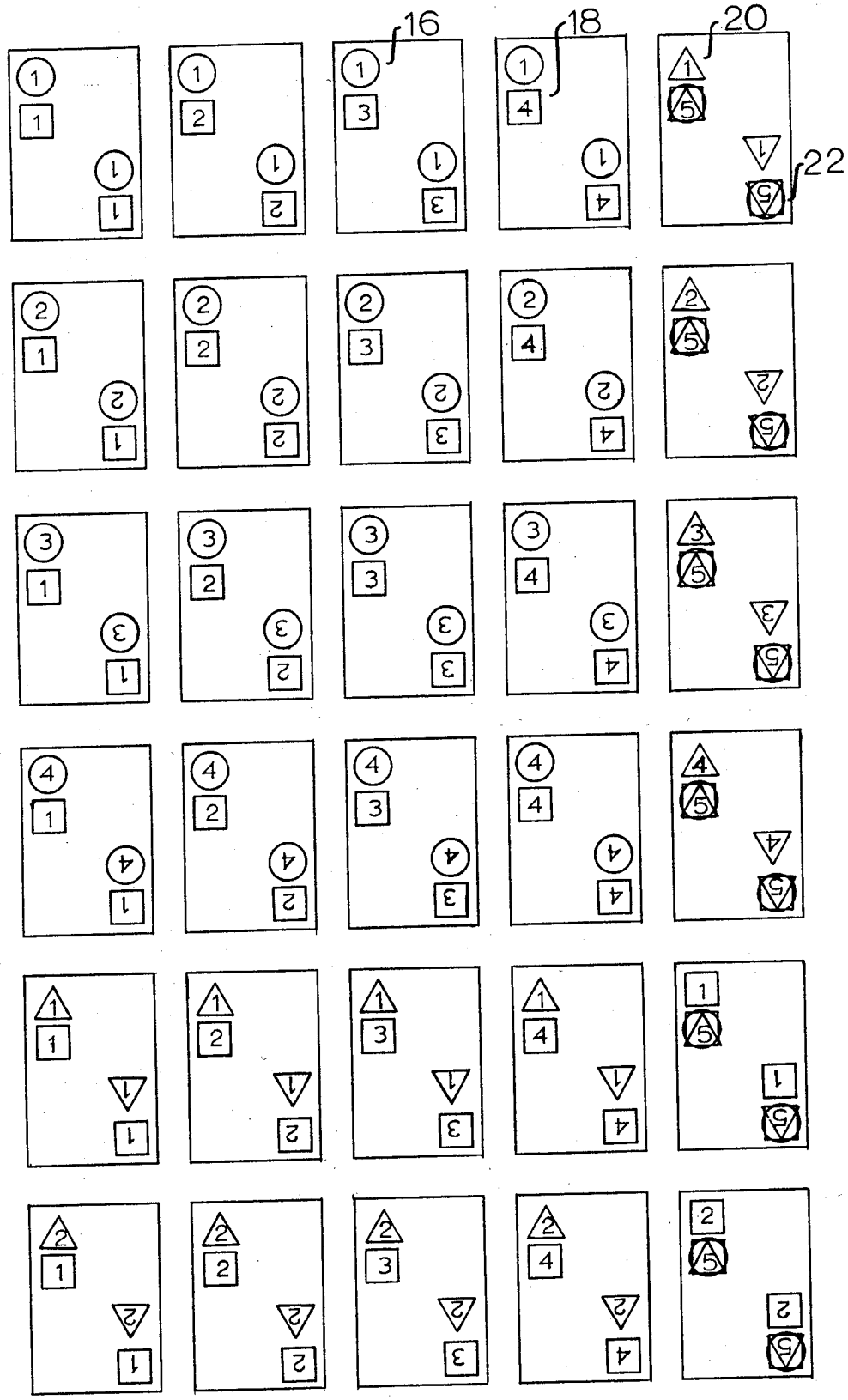
FIGS. 2A and 2B show the specific preferred fair two-value deck of the invention.
Figure 2B:
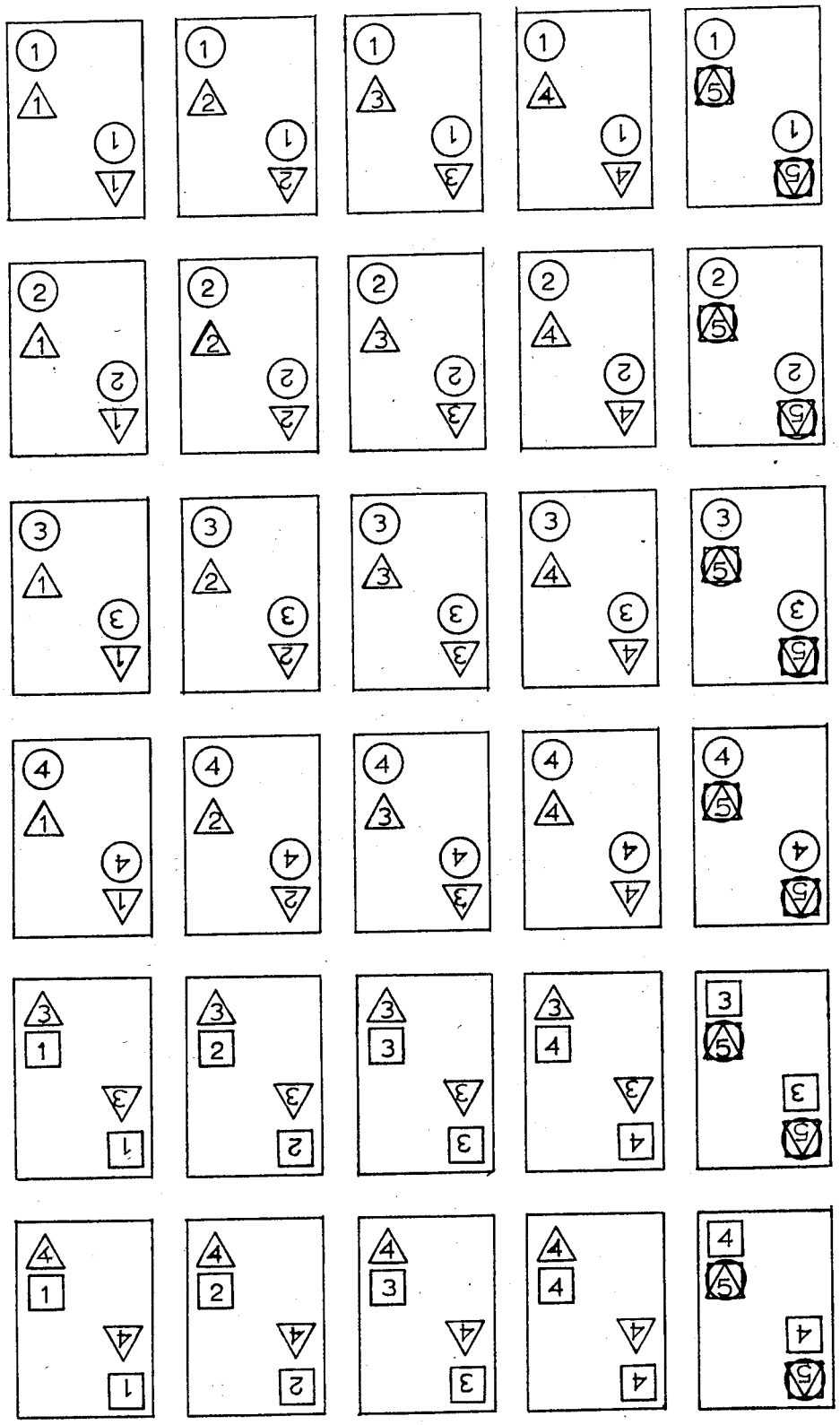

FIGS. 2A and 2B show diagrammatically a full deck of sixty cards according to the invention, indicating the combinations of two-values (suit-value pairs) which appear on each of the sixty cards in order to generate a fair two-valued deck. The three different suits are displayed in this instance as circles, 16, squares, 18, and triangles, 20. The half-wild values, 22, are shown as well. FIG. 2 illustrates just one of the many feasible two-value decks of the invention whose statistics result in fair games.

Figure 3:
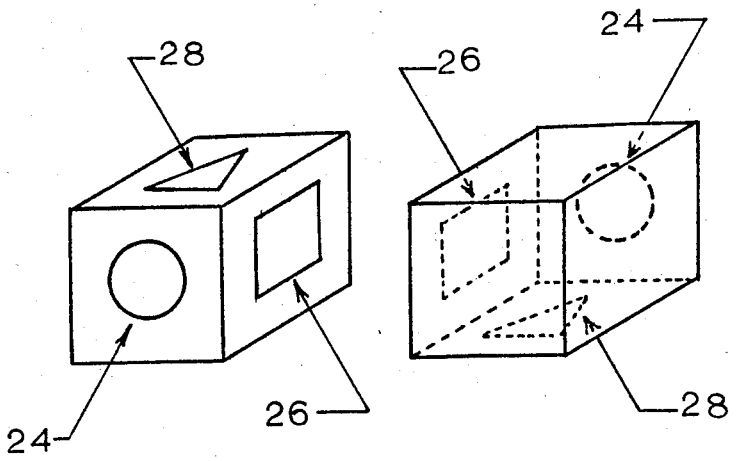
FIG. 3 shows the optional die of the specific preferred embodiment of the invention (although it is not necessarily drawn to scale).

FIG. 3 illustrates the optional die which can be incorporated into games using the two-value deck of FIGS. 2A and 2B show. Analogous dice can be used for other suits, and for other decks based on Table I as well. The three suits, circles, 24, squares, 26, and triangles, 28, should appear twice on each die. Each suit should appear centered on a given face of the die, and also centered on the opposite face of the die.

A general indication of the manner in which various card games are played with a deck of cards according to the invention (e.g.: the deck of cards illustrated in FIGS. 2A and 2B show plus the die illustrated in FIG. 3) will now be given so that the versatility and improved statistics with a deck of cards according to the invention will be apparent to card players. The first game (Poker) accentuates the improved statistics of the invention. The second game ('Close, But No Cigar') is an example of a new game that could only be developed as a result of the present invention, and hence accentuates the versatility of a deck of cards according to the invention. These examples are meant to demonstrate the improved utility of the invention, and are illustrative only, and not exhaustive.

POKER (Five Card Draw)

1. The standard rules of Poker apply when applicable (except when otherwise noted).
2. Each player is dealt five cards.
3. The dealer rolls the die. Whichever suit appears on the top face of the die becomes the 'dummy suit'.
4. Only cards containing the 'dummy suit' in either of the display areas are valid for that particular hand. However, the 'dummy suit' value is not the display area of value. Instead, the other display area suit-value on any card containing the 'dummy suit' is to be used for the Poker hand. The half-wild (W-5) display area values do not count as 'dummy suit' cards. Instead, they are used in poker hands which contain the 'dummy suit' card in the other display area.

5. Based on probability theory, the ranking of hands is as follows:

| Rank | Poker Hand | Probability | Probability with Standard Deck |
|---|---|---|---|
| 1 | four 5's | 0.00001 | (see 4 of a kind) |
| 2 | five of a kind | 0.00004 | 0 |
| 3 | straight flush | 0.00114 | 0.000014 |
| 4 | straight | 0.00186 | 0.00394 |
| 5 | four of a kind (not 5's) | 0.00267 | 0.00024 |
| 6 | full house | 0.00377 | 0.00144 |
| 7 | flush | 0.00453 | 0.00197 |
| 8 | no dummy hand* | 0.00778 | — |
| 9 | two pair | 0.04380 | 0.04754 |
| 10 | three of a kind | 0.05173 | 0.02113 |
| 11 | one pair | 0.39228 | 0.42257 |
| 12 | no pair | 0.49490 | 0.50116 |

*= A 'no dummy hand' is one in which the player has no cards in his or her hand that contain the dummy suit (excluding the half-wild display areas).

It should be noted that while the best poker hands are still relatively difficult to get, the probability of obtaining a good hand has been increased substantially using the present invention (for example, a straight flush is still one of the most difficult hands to be dealt, however, the chances of being dealt a straight flush has been improved by a factor of 100). At the same time, the probabilities of the lesser hands have not be significantly changed.

6. As in regular poker a player can discard either none, one, two, or three of his or her cards, and replace them with the same number of cards from the top of the deck in an attempt to improve his or her hand. Four cards may be selected if the player has a 'dummy suit' card with a half-wild (W-5) display value as the other display area.
7. Cards that do not contain the 'dummy suit' cannot be used toward the final poker hand. As a result, in order to have a flush, straight, full house, straight flush, or five of a kind, the player must have five cards which all contain the 'dummy suit' plus the correct poker hand with the other suit-value pair on the cards in his or her hand.
8. Since thirty-six out of sixty cards contain the same suit (regardless of which suit), it is very difficult to be dealt five cards in which none of them contain the 'dummy suit'. As a result, a hand with no 'dummy suit' cards is called a "no dummy hand". The "no dummy hand" ranks 8th on the list given in rule #5.
9. In the event of a tie, the player with the least 'dummy suit' cards wins.
10. If there is still a tie, as in regular poker, the highest number value of the valid cards wins. For example, three 4's beats three 2's, and similarly, 4,4,4,3,1 beats 4,4,4,2,1.
11. If there is still a tie, whoever has the best hand with their 'dummy suit' cards wins.
12. No particular suit ranks higher than any other particular suit.

Figure 4:
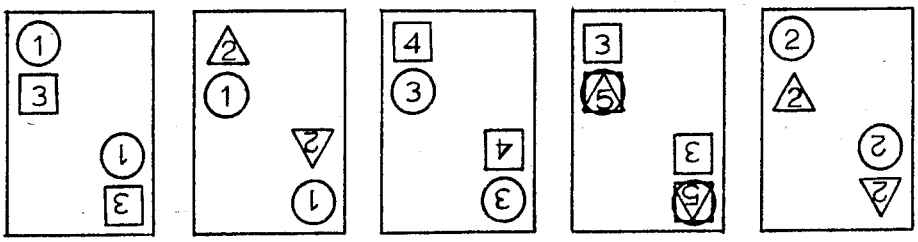
FIG. 4 through FIG. 8 show representative hands that could occur in the game of Poker, as well as their subsequent manipulations according to the invention.
Figure 5:
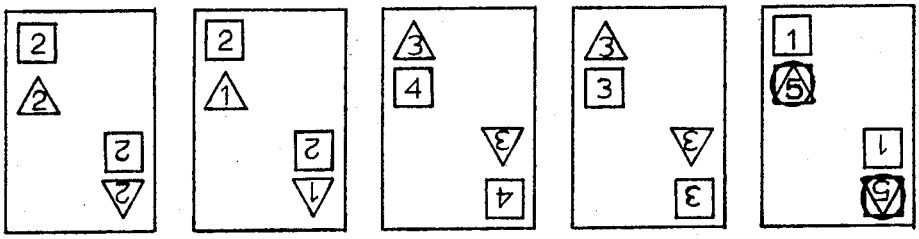
Figure 6:
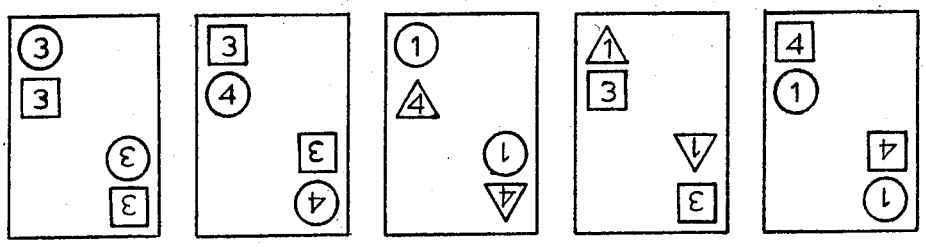

As a working example, refer to FIGS. 4 through 6. Player #1 is dealt the hand shown in FIG. 4. Player #2 is dealt the hand shown in FIG. 5. Player #3 is dealt the hand shown in FIG. 6. The dealer (player #3) rolls the die, and gets a circle. Therefore 'circle' (C) is the dummy suit. As a result, the hands should be rearranged as indicated in FIG. 7 (for player #1) and in FIG. 8 (for player #3).

Figure 7:
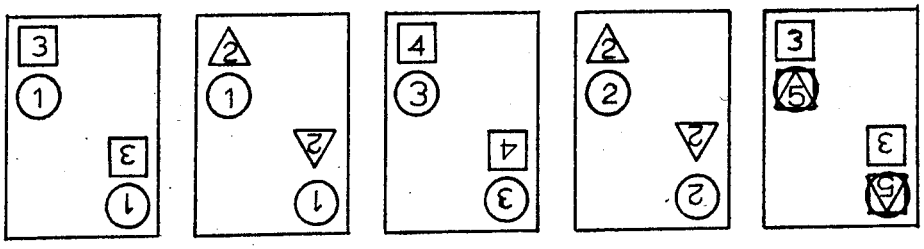

For player #1, the last card in FIG. 7 has no value in this hand since it has no circle. However, the first four cards do count, and player #1 presently has S-3, T-2, S-4, T-2, 0 (where 0=a card of no value). In effect, player #1 has a pair of 2's, so he or she would probably discard the S-3, S-4, and 0, and draw three new cards.

From FIG. 5 is is apparent that player #2 has no circles, and as a result his (or her) hand is 0,0,0,0,0. This is a "no dummy hand" which is very good (contrary to a similar poker hand using a standard fifty-two card deck). Player #2 will probably not draw any cards.

Figure 8:
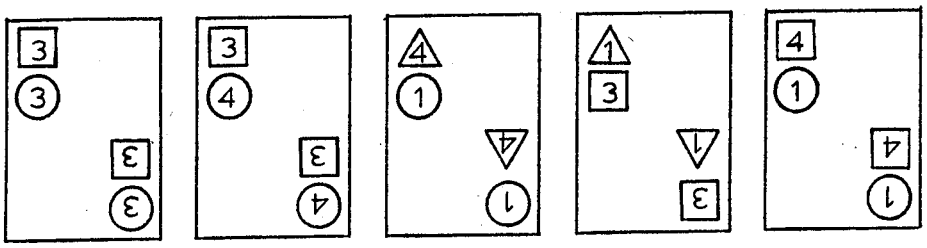

The dealer (player #3) has the hand indicated in FIG. 8, which is essentially S-3, S-3, T-4, 0, S-4. This is presently two pair (two 3's and two 4's). Player #3 would probably discard the 0 and draw one new card.

The importance of the roll of the die is apparent, as can be seen by keeping the same example as above, only changing the roll of the die to a square. Now 'square' would be the dummy suit, and the three hands would be changed to the following:

Player #1: C-1, 0, C-3, W-5, 0=No pair) strategy: keep W-5, and draw four cards).

Player #2: T-2, T-1, T-3, T-3, W-5=Flush (strategy: draw no new cards).

Player #3: C-3, C-4, 0, T-1, C-1=One pair (strategy: keep T-1, & C-1; draw three).

This unique feature makes the game more challenging and exciting. In fact, an advanced variation could consist of rolling the die after drawing new cards. In effect, each player would be playing his or her hand in anticipation of a specific dummy suit (which may or may not occur).

CLOSE, BUT NO CIGAR (A Matching Game)

Object of the game: To discard all your cards.

Rules:

1. Each player is dealt seven cards.
2. The remaining cards are placed face down in a stack. This is the 'selection stack.'
3. The top card of the 'selection stack' is turned over and placed face up, next to the 'selection stack.' This is called the 'discard stack.'
4. If the 'discard stack' has a W-5 in either of its display areas, the dealer shall roll the die until a suit comes up which differs from the suit of the other display area on the 'discard stack' card. This becomes the temporary suit of the W-5 display area.
5. The player to the left of the dealer goes first. Play continues in a clockwise manner.
6. In order to make a play, the player must have at least one card in his or her hand that both matches one display area of the 'discard stack' card exactly (both suit and value), and matches the other display area of the 'discard stack' partially (either the suit or the value).
7. If the player can make a play, he or she must place any one appropriate card face on top of the discard stack. This becomes the new card to match (hence the new discard stack card). Generally, only one play is allowed per turn.
8. A half-wild (W-5) display area matches any suit, but can be used in play only if the other display area on the card matches either display area of the discard stack card identically.
9. A half-wild (W-5) display area matches another half-wild (W-5) display area identically, but can be used in play only if the other display area on the card matches either the suit or the value of the other display area of the discard stack card.

10. If a card containing a W-5 is played, that player shall roll the die:

(a) If the roll of the die differs from the suit of the other display area on the played card, the suit of the rolled die becomes the temporary suit of the half-wild display area.

(b) If the roll of the die matches the suit of the other display area on the played card, the roller gets an optional additional play. But first, the player must reroll the die until rule 10a) is achieved. A maximum of one additional play is allowed for each card discarded which contains a W-5.

11. If the player has no cards in his or her hand that can be played as per rules (6) through (10), then the player must draw the top card from the 'selection stack', and play it if possible. If this card cannot be played, the player must add it to his or her hand. The players turn is then over, and play continues to the left.

12. The first player who discards all of his or her cards is the winner of the hand.

13. If all the 'selection stack' cards are used up, and no one has won the hand yet, keep the present 'discard stack' card face up, and reshuffle the remaining cards of the 'discard stack'. Place these cards face down as the new 'selection stack' and continue play as before.

Scoring:

1. The winner of a hand gets no points.
2. Each loser gets the total of the values of the display areas on the cards in his or her hand when a winner is declared. This is their point score.
3. The winner of the game is the player with the least number of points at the end of the game.
4. The game ends when any player has a point score greater than or equal to 100.

Figure 9:
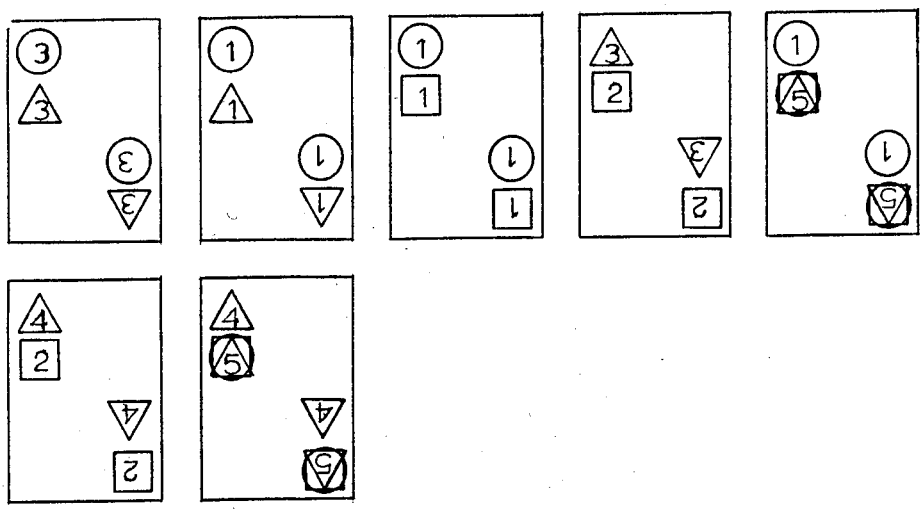
FIG. 9 through FIG. 11 show representative hands that could occur in a new game according to the invention.
Figure 10:
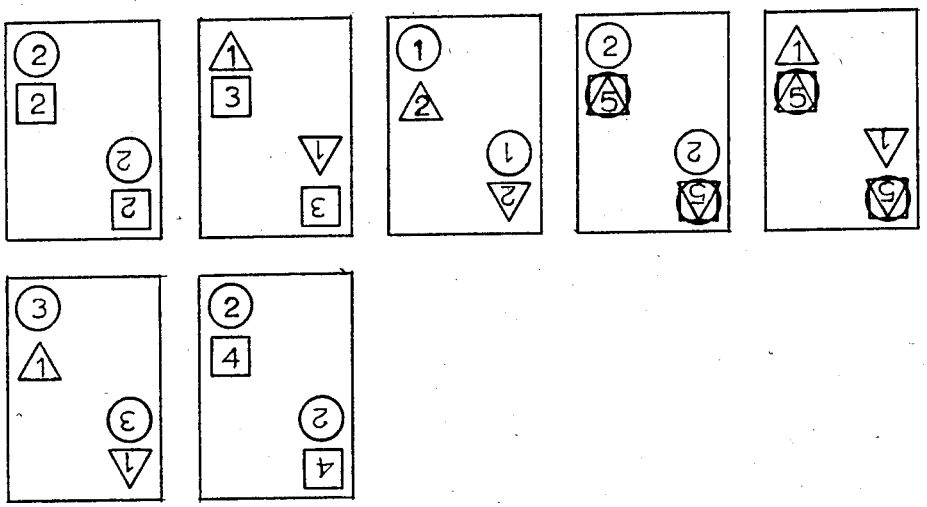
Figure 11:
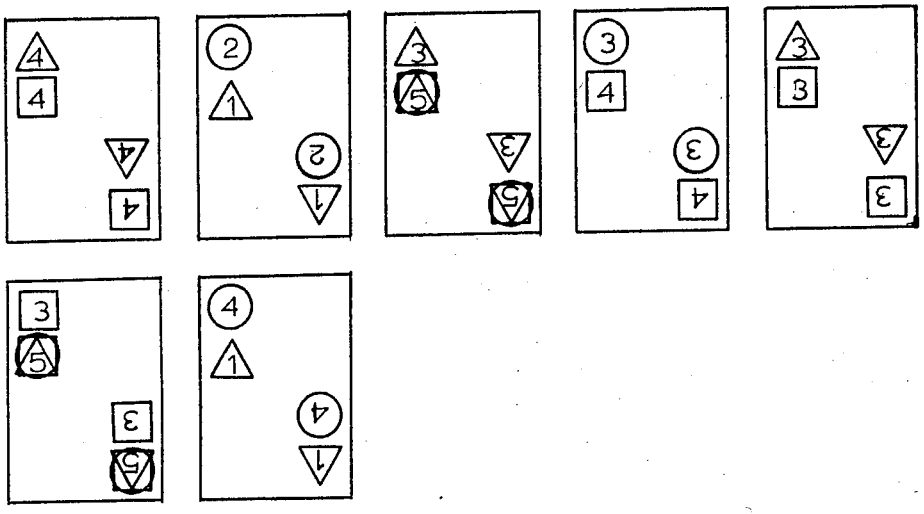

As a working example, refer to FIG. 9 through FIG. 11. Let the discard stack card be the card shown in FIG. 1. Player #1 is dealt the hand shown in FIG. 9. Player #1 has one card that meets the requirements of rule 6: T-3/S-2. Note that the T-3 matches one of the display areas of the discard stack card identically, while the suit of the S-2 matches the suit of the other display area on the discard stack card. Now the new discard stack card is T-3/S-2.

Player #2 has the hand shown in FIG. 10. Player #2 has one card that matches the S-2 identically (S-2/C-2). However, the C-2 has nothing in common with the T-3 of the discard stack, so this card is not sufficient for play. Therefore player #2 selects the top card from the 'selection stack' (assume this card is C-2/T-3). In this case, the T-3 matches the dicard stack card identically, while the C-2 matches the S-2 of the discard stack card partially. This card is then placed on top of the T-3/S-2, and becomes the new discard stack card.

Player #3 has the hand shown in FIG. 11. Player #3 has two cards the meet the criteria of rule 6: C-2/T-1, and T-3/W-5. From rule 7, player #3 can choose to play T-3/W-5. From rules 8,9, and 10, the die rolled (assume 'square'). Therefore the new discard stack card is essentially T-3/S-5.

The game continues with player #1, etc. This game is unique to the deck of cards of the present invention. Additional new games can also be developed as a result of the present invention and its improved utility.

What I claim is:

1. A deck of playing cards comprising between 45 and 70 cards, each of said cards being of generally the same configuration, preferably rectangular and of standard size, and having visually similar rear faces;

each of said cards is delineated into two display areas, and in each display area there is a first symbol designating a suit which is confined to between two and eight different possibilities, coupled with a second symbol designating a value which is confined to between two and eight different possibilities depending on the specific deck;

the two display areas of the cards of a given playing card deck are comprised such that every specific suit-value pair is coupled once with every other specific suit-value pair in the minimum number of cards;

the same suit-value pair does not appear in both display areas of any individual card within a given playing card deck;

the two display areas of any given card are not visually distinctive, and are designed such that the two display areas appear near the upper lefthand corner of the front face in a right-side-up position, and also near the lower righthand corner of the front face in an upside-down position, whereby on a normal sized playing card (6.25 cm×8.75 cm) one display area (hereby denoted as suit-value 1) should appear within 2 cm of the upper lefthand corner of the card, and the other display area (hereby denoted as suit-value 2) should appear directly below suit-value 1, between 2 cm and 4 cm from the upper lefthand corner of the card and drawn to the same scale as suit-value 1 in a manner such that when the card is rotated 180° clockwise, the display areas should reappear in the upper lefthand corner, only the positions of suit-value 1 and suit-value 2 should be reversed.

2. The deck of playing cards according to claim 1, wherein the same suit does not appear in both display areas of any given card of the deck.

3. The deck of playing cards according to claim 1, wherein the same value does not appear in both display areas of any given card of the deck.

4. The deck of playing cards according to claim 2, wherein the deck consists specifically of suit-value pairs confined to only three different suits and four different values, such that a deck of only forty-eight cards allows every value of a given suit to be paired once with every value of the other suits.

5. The deck of playing cards according to claim 4, wherein the deck includes twelve additional cards consisting of a half-wild display area which contains a fifth value that is wild in terms of its suit (as one display area), coupled once with each of the twelve unique suit-valve pairs (as the other display area).

6. The deck of playing cards according to claim 5, wherein the deck is supplemented with a die or other suitable device which represents the various suits, for the purpose of arbitrarily allowing one suit to rank differently than the other suits.

* * * * *